United States Patent [19]

Klingler

[11] 4,334,492

[45] Jun. 15, 1982

[54] MANIPULATING ROTARY CONTROL DEVICE

[76] Inventor: Michael R. Klingler, 1238 S. Courtland, Park Ridge, Ill. 60068

[21] Appl. No.: 158,491

[22] Filed: Jun. 11, 1980

Related U.S. Application Data

[63] Continuation-in-part of Ser. No. 11,202, Feb. 12, 1979, Pat. No. 4,213,416.

[51] Int. Cl.[3] ..... G09F 11/04; G09F 11/02

[52] U.S. Cl. ..... 116/309

[58] Field of Search ..... 116/309, 318, 307, 315, 116/311, 312, 314, 306, 245, 200, 323, 321, DIG. 31; 16/118, 121; 74/553, 10.22

[56] References Cited

U.S. PATENT DOCUMENTS

| | | | |
|---|---|---|---|
| 783,210 | 2/1905 | Lewis | 74/553 |
| 1,563,635 | 12/1925 | Kasch | 74/553 |
| 1,629,891 | 5/1927 | Shaw | 74/553 |
| 2,201,540 | 5/1940 | Kauffman | 116/200 |
| 4,213,416 | 7/1980 | Klinger | 116/309 |

*Primary Examiner*—Kyle L. Howell
*Assistant Examiner*—Denis E. Corr
*Attorney, Agent, or Firm*—Cook, Wetzel & Egan, Ltd.

[57] ABSTRACT

A number of control knob constructions for use in selectively positioning a control shaft such as by rotation and/or axial movement thereof. In one form, the control device includes a one-piece dial-hub element and a knob portion formed of thermal insulating material and having a connecting portion connected to the dial-hub element. In a second form, the control device includes a one-piece dial-knob element and a hub connected to the dial, the dial-knob element being formed of a thermal insulating material. The structure interconnecting the elements is formed integrally with the one-piece element in each of the two forms.

17 Claims, 9 Drawing Figures

FIG. 1
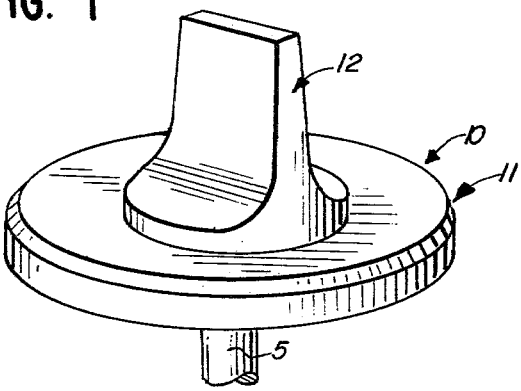
FIG. 6
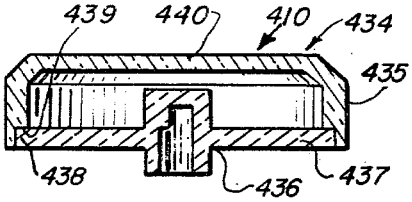
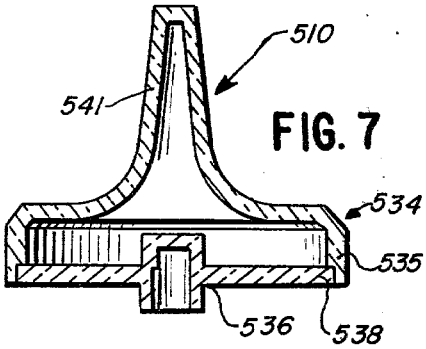
FIG. 7
FIG. 2
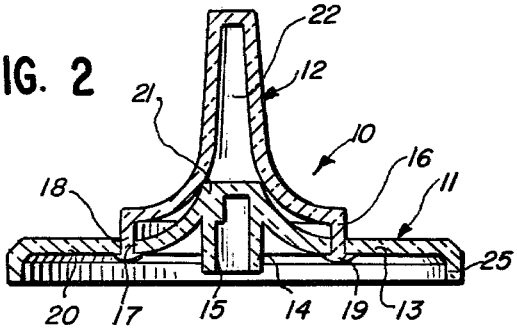
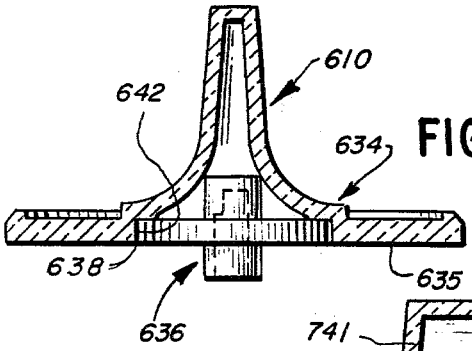
FIG. 8
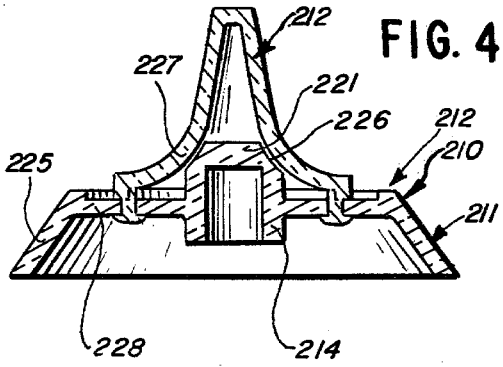
FIG. 4
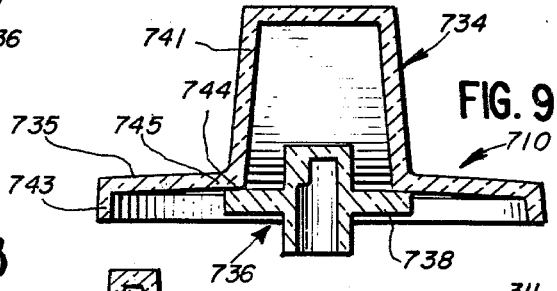
FIG. 9
FIG. 3
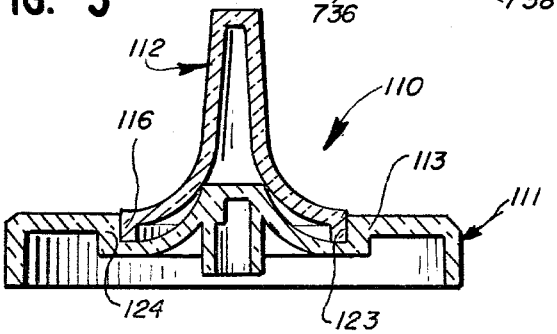
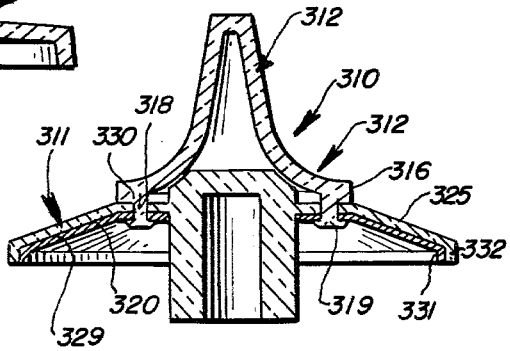
FIG. 5

MANIPULATING ROTARY CONTROL DEVICE

CROSS-REFERENCE TO RELATED APPLICATION

This invention comprises a continuation-in-part of my copending application for U.S. Letters Patent, Ser. No. 11,202, filed Feb. 12, 1979, now U.S. Pat. No. 4,213,416 and entitled Manipulating Rotary Control Device.

TECHNICAL FIELD

This invention relates to rotary control devices and in particular to such control devices for use in manually controlling rotatable control shafts.

BACKGROUND ART

It is conventional in controlling rotary shafts, such as the shaft of ranges and the like, to provide a control knob adapted to be secured to the projecting end of the control shaft forwardly of the outer wall of the range. Such control knobs utilize hub details which make the control knobs relatively expensive.

Such knobs are conventionally associated with dials for indicating to the user the disposition of the rotary shaft. It is necessary to maintain a relatively low temperature of the knob to permit the user to manipulate the shaft without injury. In one conventional range structure, the control shaft projects forwardly through a small opening in the range wall. The shaft is rotatable and axially movable. Conventionally, the shaft must be urged axially inwardly before rotation of the shaft may be effected, thereby to prevent inadvertent rotation of the shaft.

A number of different rotary control devices are disclosed in prior art patents, including U.S. Pat. No. 783,210 of Roland C. Lewis. The Lewis patent discloses a dial and knob structure for use with permutation locks wherein a dial 6 is removably associated with a hub 4 and a knob 10 by interlocking serrations.

Henry J. Kasch shows, in U.S. Pat. No. 1,563,635 a knob and dial assembly wherein the knob 2 is connected to the dial 1 by a fitted hub element 10.

In U.S. Pat. No. 1,629,891, Louis E. Shaw shows a radiodial wherein the metal hub element 21 is secured to the knob portion of the dial in a boss 20 thereof. The knob portion is formed integrally with the dial portion 17.

In U.S. Pat. No. 2,201,540 of Walter L. Kauffman, II, a pressure control knob is provided wherein a shaft extends through the two-piece hub and knob structure and is provided at its distal end with a dial portion 21 exposed outwardly of the knob.

DISCLOSURE OF INVENTION

The present invention comprehends a number of novel rotary control device configurations wherein the knob, dial and hub portions are constructed and arranged in a novel manner not shown or suggested in the prior art and providing improved low cost manufacture and extended useful life thereof.

In one form, the manipulating rotary control device of the present invention includes a one-piece dial-hub element defining a first, dial portion, and a second hub portion centrally of the dial portion and defining a socket arranged for selective removable coaxial mounting thereof onto a rotatable control shaft end, the dial-hub element being arranged to provide access to the socket from one facial side of the dial, a manipulating knob formed of a thermal insulation material and having a connecting portion adapted to be connected to the dial-hub element for effecting rotation of the shaft as a result of manual rotation of the knob about the axis of the shaft, and means interconnecting the knob connecting portion and the dial-hub element for rotating the shaft about the axis thereof as an incident of the manual rotation of the knob, said knob including a portion covering the hub at the facial side of the dial opposite the one facial side.

In another form, the manipulating rotary control device includes a one-piece dial-knob element defining a first dial portion having a peripheral portion, and a second manipulating knob portion, the dial-knob element being formed of a thermal insulation material, a hub defining a socket arranged for selective removable coaxial mounting thereof onto a control shaft end, and a peripheral connecting portion adapted to be connected to the dial peripheral portion for effecting rotation of the dial as a result of manual rotation of the knob about the axis of the socket, and means interconnecting the dial and hub peripheral portions for rotating the shaft about the axis thereof as an incident of the manual rotation of the knob, the dial-knob element being formed of synthetic resin.

In either form, the knob portion is preferably formed of an insulating material, such as a synthetic resin.

The interconnecting means may be formed integrally with the one-piece element in each of the disclosed forms. In the one-piece dial-hub element form, the interconnecting means may include projections on the knob extending through suitable apertures in the dial-hub element.

A metal indicator may be mounted to the one-piece dial-hub element, and in the illustrated embodiment, is interlocked thereto by the means interlocking the knob thereto.

The hub, in the illustrated embodiments, is provided with a transverse closure for preventing ingress of moisture through the socket to the control shaft.

In one form, the dial-hub element defines a cylindrical wall and the knob is press fitted thereinto.

In the form of the invention wherein the knob and dial are integrally formed, the dial may be provided with a peripheral cylindrical wall with the hub defining a peripheral portion force fitted thereinto.

In one form, the knob and dial element define a flat circular wall with the periphery thereof defining a turned flange interconnecting with the peripheral portion of the hub.

In one form, the dial and knob are spaced from the hub at all portions thereof other than the peripheral interconnecting portions.

In each of the disclosed forms of the invention, the control device is extremely simple and economical of construction while yet providing the highly desirable features discussed above. In each form, the hub may be formed of a wear-resistant material, such as metal, or may be formed of a molded synthetic resin as desired. In each form, the assembly of the rotary device is extremely simple and economical.

BRIEF DESCRIPTION OF THE DRAWING

Other features and advantages of the invention will be apparent from the following description taken in connection with the accompanying drawing wherein:

FIG. 1 is a perspective view of a rotary control device embodying the invention;

FIG. 2 is a diametric section thereof;

FIG. 3 is a diametric section of another form of rotary control device generally similar to that of FIG. 2, but utilizing different interconnecting means;

FIG. 4 is a diametric section of still another form of rotary control device embodying the invention;

FIG. 5 is a diametric section of yet another form of rotary control device embodying the invention;

FIG. 6 is a diametric section of yet another form of rotary control device embodying the invention wherein the knob and dial comprise a one-piece element interconnected to the hub;

FIG. 7 is a diametric section of still another form of rotary control device embodying the invention generally similar to that of FIG. 6 but utilizing a projecting knob portion;

FIG. 8 is a diametric section of yet another form of rotary control device embodying the invention generally similar to that of FIG. 7 but utilizing a radially projecting dial portion; and FIG. 9 is a diametric section of a further form of rotary control device embodying the invention utilizing a modified form of one-piece knob and dial element interconnected to the hub.

BEST MODE FOR CARRYING OUT THE INVENTION

In the exemplary embodiments of the invention as disclosed in the drawing, a number of different forms of rotary control devices are illustrated. In each of the forms of FIGS. 1–5, the control device is defined by a one-piece dial-hub element and a separate manipulating knob interconnected therewith. In the embodiments of FIGS. 6 and 7, the rotary control devices are defined by a one-piece knob-dial element interconnected to a separate hub element.

More specifically, with reference to the embodiment of FIGS. 1 and 2, the invention comprehends an improved manipulating rotary control device generally designated 10 including a one-piece dial-hub element 11 and a separate knob element 12.

Element 11 defines a first, dial portion 13, and a second, central hub portion 14. The hub portion defines an inwardly opening socket 15 for receiving the end of a control shaft S (FIG. 1). The socket is accessible from the inner facial side of the control device 10, as best seen in FIG. 2.

Knob 12 is preferably formed of a thermally insulating material, such as a synthetic resin, and is provided with a connecting portion 16 adapted to be connected to the dial-hub element 11 for effecting rotation of the shaft as a result of manual rotation of the knob about the axis of the shaft.

As best seen in FIG. 2, the means for interconnecting knob portion 16 to the one-piece dial-hub element 11 may comprise a plurality of apertures 17 in the dial-hub element and a cooperating, complementary plurality of projections 18 formed integrally with the connecting portion 16 of knob 12. Projections 18 may extend fully through the apertures 17 and may be thermally deformed as at 19 to define interlocking shoulders engaging the inner surface 20 of the dial-hub element 11.

As shown in FIG. 2, hub portion 14 may define a closed outer end 21 received in an inwardly opening recess 22 of the knob 12. In the embodiment of FIG. 2, hub portion 21 abuts the knob 12 so as to cooperate with the formed interlocked portions 19 in securing the knob to the dial-hub element 11.

Dial-hub element 11 may be formed of any desired material, including formed metal, as the knob provides thermal insulation protecting the user against thermal injury as from heat transfer from the control shaft S.

By forming the interconnecting means 16, 17, 18, 19 integrally with the control device elements, further low cost manufacture of the control device is obtained. Where the interlocking means 19 is formed by a thermal staking operation, the knob 12 is preferably formed of a thermoplastic synthetic resin.

Referring now to the embodiment of FIG. 3, a modified form of rotary control device generally designated 110 is shown to comprise a control device generally similar to that of FIG. 2, but wherein the interconnecting means comprises a modification of the interconnecting means of the device 10. More specifically, as shown in FIG. 3, dial portion 113 of the dial-hub element 111 is provided with a central recess 123 defining an inturned cylindrical flange 124. The connecting portion 116 of knob 112 is press fitted into the cylindrical wall 124 in recess 123 to secure the knob to the dial-hub element 111.

Thus, control device 110 is similar to control device 10 and each portion thereof corresponding to a similar portion of control device is identified by the same reference numeral but 100 higher.

Another rotary control device generally designated 210 is shown in FIG. 4 to comprise a control device generally similar to control device 10 but having a frustoconical peripheral portion 225 in lieu of the turned flange portion 25 of the control device 10. As further illustrated in FIG. 4, the outer portion 221 of the hub portion 214 is provided with an arcuate surface 226 having fitted engagement with the complementary arcuate portion 227 of the knob 212.

Further, as shown in FIG. 4, the dial portion 213 further defines a flat midportion 228 which is recessed within the outer edge of the frustoconical peripheral portion 225 so as to effectively recess the knob 212 partially within the one-piece dial-hub element 211.

Thus, control device 210 is generally similar to control device 10 and portions thereof corresponding to similar portions of control device 10 are identified by similar reference numerals but 200 higher.

Referring now to the embodiment of FIG. 5, a further modified form of control device 310 is shown to comprise a structure generally similar to device 210 but having a knob 312 defining a peripheral portion 316 substantially congruent with the upper end of the frustoconical dial portion 325.

Control device 310 further includes an inner dial plate 329 secured in underlying relationship to the lower surface 320 of the dial-hub element 311 by the formed ends 319 of the projections 318 extended through the dial-hub element and aligned openings 330 in the dial plate.

It may be noted that in each of the control devices 210 and 310 the projections on the knob are spaced inwardly from the outer peripheral portion of the knob. The dial-hub element 311 is preferably formed of a transparent material, permitting viewing of the dial plate 329 therethrough.

As further shown in FIG. 5, to facilitate centering of the dial plate relative to the frustoconical dial portion 325, the dial plate may be provided with a peripheral turned annular flange 331 and the dial portion 325 may be provided with a complementary turned peripheral flange 332 in which the flange 331 is nested. Thus, the cooperating flanges 331 and 332 cooperate with the retaining shoulders 319 in securing the dial plate in the assembly.

As indicated briefly above, a second form of the invention wherein the knob and dial are formed as a one-piece element, with the hub being provided as a separate element joined to the knob-dial element at the peripheral portions thereof, is shown in FIGS. 6 and 7. More specifically, in the embodiment of FIG. 6, a rotary control device generally designated 410 is shown to comprise a one-piece dial-knob element generally designated 434 having a peripheral portion 435 comprising a turned annular flange. The hub element 436 is provided with a radial flange 437 having a peripheral portion 438 secured to flange 435 of the dial-knob element 434.

As shown in FIG. 6, flange 435 may be provided with a radially and axially inwardly opening recess 439 receiving the peripheral portion 438 of the hub flange 437 in a force fit relationship whereby the dial-knob element is fixedly secured to the hub.

As further shown in FIG. 6, dial-knob element 434 defines a circular flat midportion 440 spaced from the hub 436 in the assembled arrangement of the control device 410. Dial-knob element 434 is preferably formed of a thermally insulating material, such as synthetic resin. The hub element may be formed of any suitable material, such as metal, the dial-knob element insulating the user of the control device from contact with the metal hub as a result of the enclosing relationship therebetween.

Referring now to FIG. 7, a further modified form of rotary control device generally designated 510 is shown to comprise a control device generally similar to control device 410 in utilizing a one-piece dial-knob element generally designated 534, and a hub element 536 having a peripheral portion 538 fixedly secured to the peripheral portion 535 of the dial-knob element. However, as seen in FIG. 7, the knob portion 541 of the element 534 comprises an outwardly projecting tapered portion generally similar to the tapered knob 12 configuration of the control device 10.

Referring now to FIG. 8, still another modified form of rotary control device embodying the invention generally designated 610 is shown to comprise a control device generally similar to control device 510 of FIG. 7, but utilizing a one-piece dial-knob element generally designated 634 having a radially projecting peripheral portion 635 defining a cylindrical shoulder 642 receiving the peripheral portion 638 of a hub element generally designated 636. Hub element portion 638 may be secured to the dial-knob element cylindrical surface 642 as by heat staking or sonic welding, etc.

As shown in FIG. 9, a still further modified form of rotary control device generally designated 710 comprises a control device having a modified form of dial-knob element generally designated 734 provided with a knob portion 741, and a dial portion 735 provided with a downturned peripheral flange 743. The hub insert element generally designated 736 defines a peripheral portion 738 which is secured to the dial portion 735 of the dial-knob element 734 as by heat staking, sonic welding, etc. As shown in FIG. 9, the peripheral portion 738 defines a planar annular peripheral surface 744 secured to a complementary planar portion of the connection between knob 741 and dial 735 of element 734. As further shown in FIG. 9, the flange 743 effectively encircles the hub peripheral connecting portion 738.

Thus, in each of the control devices 410, 510, 610, and 710, a novel structural arrangement is provided wherein the one-piece dial-knob element, which may be formed of a thermally insulating material, such as synthetic resin, is provided with an annular peripheral portion to which a complementary peripheral portion of the radially projecting flange of the hub element is fixedly secured in the assembled arrangement of the control device. In each of the control devices 410, 510, 610 and 710, the dial-knob element is spaced from the hub element at all positions other than at the interconnecting peripheral flange portions.

The mounting of the dial-knob element to the peripheral portion of the hub flange provides an improved, stable, secure connection therebetween which is extremely simple and economical of construction and which permits facilitated assembly of the control device.

As indicated above, similar portions of the different embodiments are identified by similar reference numerals except 100 different.

The foregoing disclosure of specific embodiments is illustrative of the broad inventive concepts comprehended by the invention.

I claim:

1. A manipulating rotary control device comprising:

a one-piece dial-hub element defining a first, dial portion and a second hub portion centrally of said dial portion and defining a socket arranged for selective removable coaxial mounting thereof onto a rotatable control shaft end, said dial-hub element being arranged to provide access to said socket from one facial side of said dial;

a manipulating knob formed of a thermal insulation material and having a connecting portion adapted to be connected to said dial-hub element for effecting rotation of said shaft as a result of manual rotation of said knob about the axis of said shaft; and means interconnecting said knob connecting portion and said dial-hub element for rotating said shaft about the axis thereof as an incident of said manual rotation of the knob, said knob including a portion covering said hub at the facial side of the dial opposite said one facial side, said dial-hub element being provided with a plurality of apertures, and said knob being provided with a plurality of projections complementary to said apertures and fixedly secured therein.

2. The manipulating rotary control device of claim 1 wherein said projections are formed integrally with said knob.

3. The manipulating rotary control device of claim 1 wherein said projections are formed integrally with said knob and said apertures are provided in the dial portion of the dial-hub element, said projections extending fully through said apertures.

4. The manipulating rotary control device of claim 1 wherein said projections are formed integrally with said knob and said apertures are provided in the dial portion of the dial-hub element, said projections extending fully through said apertures and having distal ends deformed to define interlocking shoulders preventing withdrawal of said projections from said apertures.

5. A manipulating rotary control device comprising:

a one-piece dial-knob element defining a dial portion having a peripheral portion, and a manipulating knob portion, said dial-knob element being formed of a thermal insulation material;

a hub defining a socket arranged for selective removable coaxial mounting thereof onto a control shaft end, and a peripheral connecting portion adapted to be connected to said dial peripheral portion for effecting rotation of said dial as a result of manual rotation of said knob about the axis of said socket; and means interconnecting said dial and hub peripheral portions for rotating said shaft about the axis thereof as an incident of said manual rotation of the knob, said dial-knob element being formed of synthetic resin.

6. The manipulating rotary control device of claim 5 wherein said dial and hub peripheral portions are force fitted to form the interconnection therebetween.

7. The manipulating rotary control device of claim 5 wherein said dial-knob element is spaced from said hub at all portions other than at said peripheral portions.

8. The manipulating rotary control device of claim 5 wherein said hub is formed of metal and said peripheral portion of the dial-knob element encloses said peripheral portions of the hub.

9. The manipulating rotary control device of claim 5 wherein said hub defines a closure extending across the outer ends of said socket.

10. The manipulating rotary control device of claim 5 wherein said knob and dial portions comprise a flat circular wall and said dial peripheral portion defines a cylindrical turned flange.

11. The manipulating rotary control device of claim 5 wherein said dial peripheral portion comprises a cylindrical flange having a radially inner, annular recess receiving said peripheral portion of the hub.

12. The manipulating rotary control device of claim 5 wherein said dial portion defines a radially inner cylindrical surface portion, said hub peripheral connecting portion being secured to said surface portion.

13. The manipulating rotary control device of claim 5 wherein said dial portion defines a radially inner cylindrical surface portion, said hub peripheral connecting portion being secured to said surface portion to extend generally flush with said dial portion.

14. The manipulating rotary control device of claim 5 wherein said dial portion defines a flat, annular portion defining a radially inner cylindrical surface portion, said hub peripheral connecting portion being secured to said surface portion.

15. The manipulating rotary control device of claim 5 wherein said dial portion defines a flat annular portion defining a radially inner connection to said knob portion, said hub peripheral connecting portion being secured to said connection.

16. The manipulating rotary control device of claim 5 wherein said dial portion defines a flat annular portion defining a radially inner connection to said knob portion, said hub peripheral connecting portion defining a planar peripheral surface secured to said connection.

17. The manipulating rotary control device of claim 5 wherein said dial portion defines a flat annular portion defining a radially inner connection to said knob portion, said hub peripheral connecting portion defining a planar peripheral surface secured to said connection, said dial portion further defining a turned outer peripheral annular flange encircling said hub peripheral connecting portion.

* * * * *